United States Patent [19]

Mailliet

[11] 4,158,367

[45] Jun. 19, 1979

[54] VALVE SYSTEM AND IMPROVED ACTUATOR THEREFOR

[75] Inventor: Pierre H. Mailliet, Howald, Luxembourg

[73] Assignee: S.A. des Anciens Etablissements Paul Wurth, Luxembourg, Luxembourg

[21] Appl. No.: 780,689

[22] Filed: Mar. 23, 1977

[30] Foreign Application Priority Data

Apr. 12, 1976 [LU] Luxembourg ..... 74745

[51] Int. Cl.[2] ..... F16K 31/16; F16K 49/00; F16K 1/42

[52] U.S. Cl. ..... 137/340; 137/613; 74/96; 74/470; 251/78; 251/86; 251/333; 251/58

[58] Field of Search ..... 251/58, 232, 233, 78, 251/333, 86; 74/96, 470; 137/246, 613, 246.22, 340

[56] References Cited

U.S. PATENT DOCUMENTS

| | | | |
|---|---|---|---|
| 543,274 | 7/1895 | Speer | 251/357 X |
| 1,439,208 | 12/1922 | Veenschoten | 251/58 X |
| 1,689,799 | 10/1928 | Nordstrom | 137/246 X |
| 1,881,272 | 10/1932 | Grilli | 137/246 X |
| 2,646,065 | 7/1953 | Tyson | 137/340 X |
| 2,965,352 | 12/1960 | Coffey | 251/58 |
| 3,051,196 | 8/1962 | Miller | 251/360 X |

FOREIGN PATENT DOCUMENTS

| | | | |
|---|---|---|---|
| 323556 | 4/1970 | Sweden | 137/246.22 |

*Primary Examiner*—Arnold Rosenthal

[57] ABSTRACT

A valve actuator, for example a mechanism for imparting motion to a blast furnace evacuation valve, includes a force generator which is coupled to the valve member by a displacement mechanism including a pivotal lever and a pivot arm. The pivotal lever has a pair of angularly related arms with the free end of one arm being coupled to the force generator and the free end of the second arm being coupled to a point on the pivot arm intermediate the ends thereof by a connecting rod or rods. The pivot arm is connected to the valve member and the connecting rod or rods are articulated to both the pivot arm and to the second lever arm which may be telescoping.

29 Claims, 17 Drawing Figures

VALVE SYSTEM AND IMPROVED ACTUATOR THEREFOR

BACKGROUND OF THE INVENTION (1) Field of the Invention

The present invention relates to the exercise of control over the flow of fluids, particularly heated fluids, and especially to the venting of exhaust gases from furnaces such as those employed in the making of steel. More specifically, this invention is directed to valves for use in releasing pressurized hot gases from enclosures such as blast furnaces. Accordingly, the general objects of the present invention are to provide novel and improved methods and apparatus of such character.

(2) Description of the Prior Art

While not limited thereto in its utility, the present invention is particularly well suited for use as an evacuation or pressure relief valve for installation at the throat of a blast furnace. Such pressure relief valves conventionally comprise a valve member, actuated by a movable arm, which is provided with a sealing surface configured to cooperate with a valve seat which forms part of an exhaust gas conduit. Such pressure relief valves are associated with means for developing the power required for operating the valves and further include some form of displacement mechanism which couples the power developing means to the movable arm.

A typical pressure relief valve system suitable for employment in the environment of a pressurized furnace is shown schematically in U.S. Pat. No. 3,601,357. As disclosed in U.S. Pat. No. 3,601,357, the means for developing the power for operating the valve member comprises a hydraulic jack. The hydraulic jack is coupled to a plurality of hydro-elastic accumulators via a control system. In the patented apparatus, the hydraulic jack is directly connected, via its piston rod, to the valve member or to a pivot arm connected to the valve member. If employed to relieve pressure in the case of an explosion within the furnace, the valve member of the patented system will be opened in opposition to applied closing forces by the oppositely directed forces produced by a shock wave resulting from the explosion; the pressure applied to the valve member thus acting against and exceeding the hydro-elastic pressure of the hydraulic jack. If operated as a conventional pressure-relief valve, the state of the valve may be automatically varied through sensing the pressure of the gas in the furnace throat; signals commensurate with the sensed pressure being employed to control the operation of the hydraulic jack whereby the valve will be opened automatically if the furnace throat gas pressure rises to an abnormal level.

The valve systems as shown in U.S. Pat. No. 3,601,357 may also be employed to supply pressurized gas to pressure equalization chambers, such chambers comprising part of a furnace charging installation, during the furnace charging process.

The opening of valves of the type schematically depicted in U.S. Pat. No. 3,601,357, regardless of whether used for over-pressure protection or pressure equalization, requires the raising of the valve member to a certain height above the valve seat. If the valve is mounted at the termination of an evacuation or vent conduit, as is the case with valves employed for explosion-protection purposes and also with shut-down valves which are employed to ventilate a blast furnace when it is operating at a slow rate, the valve member could not previously have been completely removed from the fluid flow passage. This characteristic of prior pressure relief valves has proven to be a serious operational deficiency. For example, the inability to remove the valve member completely from alignment with the valve seat has made servicing, such as repair or replacement of parts subject to wear, quite difficult by limiting access to such parts. Also, the valve member and at least part of the displacement mechanism connected thereto have been exposed to the corrosive and erosive action of the hot, particle laden furnace throat gases when in the open position.

Previously proposed solutions to the problems briefly discussed above would have required the sacrifice of certain advantages incident to the use of hydraulic jacks to develop the power required for operating the valve. This diminishing of desirable characteristics would be particularly strongly felt in the case of valve systems of the type disclosed in aforementioned U.S. Pat. No. 3,601,357 which relied for operation on a hydro-elastic effect. In the design of a pressure relief valve operating system, wherein power for operating the valve member is supplied by a hydraulic jack, there must be a practical and acceptable ratio between the pressure required to maintain the valve in the closed position and that required for a closing action. Additionally, and this becomes a problem when it is desired to move the valve member through a sufficient distance so that it is completely out of the path of gases passing through the valve seat, the displacement of the piston of the hydraulic jack must be maintained within moderate limits in order to keep the consumption of hydraulic fluid within the desired limits.

There has previously been no pressure relief valve operating mechanism available which would enable the valve member to be moved completely from the path of gases being discharged through the valve seat with the aid of a hydraulic jack and wherein the valve operating system was characterized by a hydro-elastic system for controlling the operation of the jack.

SUMMARY OF THE INVENTION

The present invention overcomes the above-briefly discussed and other deficiencies and disadvantages of the prior art by providing a novel and improved valve and valve control system. A valve system in accordance with this invention includes, connected between a driven output member and a pivot arm connected to the valve member, a displacement mechanism comprising at least one lever pivotable about an axis which is oriented orthogonally to the pivot arm and to the longitudinal axis of the conduit in which the valve is installed. The pivotal lever, which has a pair of angularly related lever arms, has a first end connected to the power producer. The second end of the lever is coupled, via a connecting member, to the pivot arm which delivers the operating forces to the valve member; the connections at either end of the connecting member being articulated.

The means for developing the power for operating the valve is, in accordance with one embodiment, a hydraulic jack. The jack will be connected to a battery of hydro-elastic accumulators in accordance with a preferred embodiment. In the operation of this one embodiment of the invention, the angle between the pivotable lever and the connecting member or members continuously varies during movement of the valve member from the closed to the open position and vice versa. Accordingly, the magnitude of the forces transmitted to the valve member and the speed at which the valve member moves, the speed being inversely proportional to the applied force, will vary continuously throughout the opening and closing operation while the output force developed by the hydraulic jack and the speed of movement of its piston will remain substantially constant.

The displacement mechanism; i.e., the means for connecting the hydraulic jack piston rod to the valve member; of the present invention is designed to achieve the optimum ratio between the forces applied to the piston of the hydraulic jack under the condition when maximum power is required; i.e., when the valve is closed; and a somewhat less satisfactory ratio between these forces when the valve member is moving at a high speed in the course of the opening or closing action. The present invention thus allows the valve member to be moved quickly from alignment with the valve seat, and thus out of the stream of gases passing through the valve, by means of a hydraulic jack characterized by moderate piston travel and moderate output power.

The present invention, in accordance with one embodiment, is further characterized by the installation of a pivotal flap or butterfly valve upstream of the pressure relief valve; the pivotable flap being rotatable about a shaft which is perpendicular to the longitudinal axis of the conduit on which the pressure relief valve is installed. The operation of this flap may be coordinated with the operation of the pressure relief valve so as to permit use of the valve to control the furnace draft when the pressure relief valve is being employed as a "shut-down" valve and is in the open position.

Also in accordance with the present invention, the valve member may be connected to its pivot arm by means of a spring loaded ball joint.

In accordance with a further embodiment of the invention, the operating power for the valve may be developed by mechanical means, in the form of a winch, rather than by means of a hydraulic jack.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENTS

Figure 1:
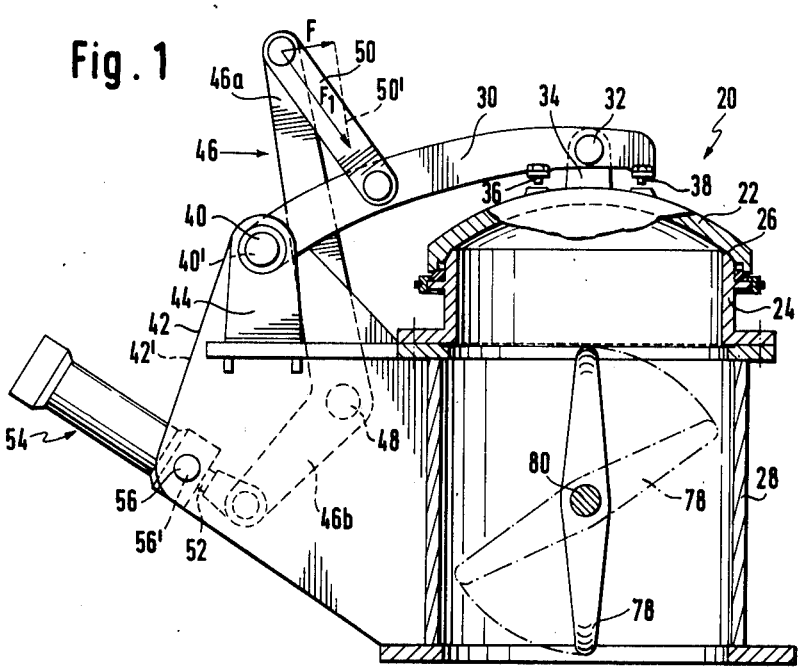
FIG. 1 is a schematic diagram, partly in vertical section, of a first embodiment of the present invention with the valve being shown in the closed position.

Referring jointly to FIGS. 1–4, a first embodiment of a valve system in accordance with the present invention is shown schematically with the valve being indicated generally at 20. Valve 20 includes a movable valve member 22. When in the closed position, as shown in FIG. 1, an annular sealing surface 26 on valve member 22 cooperates with a sealing surface on a valve seat member 24 which is affixed to the upper end of a discharge conduit 28. For purposes of explanation, it will be presumed that conduit 28 serves for the evacuation of crude gas from the throat of a blast furnace.

Valve member 22 is directly mounted on and thus actuated by a pivot arm 30. As may be seen from joint consideration of FIGS. 1 and 3, the pivot arm 30 is generally U-shaped with the two free ends of the arm being engaged by pivot shafts 40 and 40'. The assembly comprising valve member 22 and arm 30 may be pivoted about shafts 40 and 40' between the closed position of FIG. 1 and the open position of FIG. 2.

Valve member 22 is provided with a lug 34. The branches of U-shaped pivot arm 30 are disposed at opposite sides of lugs 34 and are pinned to lug 34 in such a manner that a valve member 22 can perform a slight tilting movement in relation to the pivot arm 30. The limits of this tilting motion will be set by a plurality of adjusting screws such as screws 36 and 38 which extend from pivot arm 30 toward the valve member 22. The valve member 22 may be adjusted in the interest of obtaining the desired sealing relationship between the valve member and valve seat 24 through use of screws 36 and 38.

Figure 3:
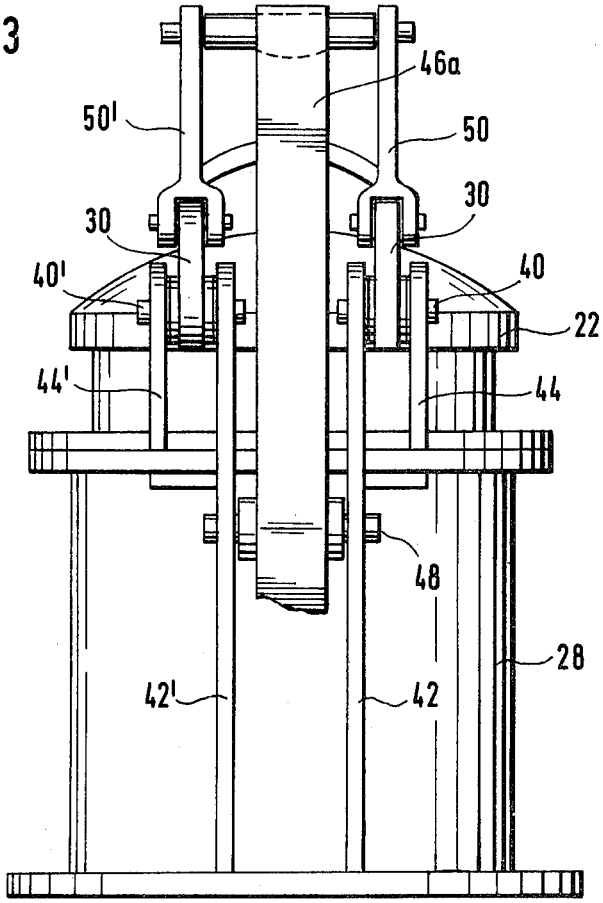
FIG. 3 is a side elevation view, taken from the left side, of the apparatus of FIGS. 1 and 2.

Continuing to refer simultaneously to FIGS. 1 and 3, the pivot shafts 40 and 40' are received in a support bracket which is integral with the conduit 28 and thus immobile. This support bracket is comprised of a pair of plates 42 and 42' and a pair of support arms 44 and 44'; the ends of the branches of pivot arm 30 being respectively captured between a plate 42 and a support arm 44 and the plates and cooperating support arms defining bearing in which the shafts 40 and 40' may rotate.

A hydraulic jack 54 is mounted by means of journals 56 and 56' between the plates 42 and 42'. The fluid supply circuit for jack 54 has been omitted from the drawing but may be of the type employing hydro-elastic accumulators as shown in aforementioned U.S. Pat. No. 3,601,357.

The output shaft or piston rod 52 of jack 54 is coupled, in the manner to be described below, to pivot arm 30 whereby jack 54 will furnish the power for pivoting arm 30 about shafts 40 to thus move valve member 22 between the closed and open positions as respectively shown in FIGS. 1 and 2. In the FIG. 1 embodiment, piston rod 52 of jack 54 is coupled to the free end of the shorter arm **46*b* of a lever 46; lever 46 being defined by a pair of angularly related arms. Lever 46 pivots about a shaft 48 which extends between plates 42 and 42' of the support bracket. The free end of the longer arm 46*a* of bent lever 46 is coupled to pivot arm 30, by means of a pair of connecting rods 50 and 50', at a point intermediate the length of arm 30. The connecting rods 50 and 50' establish an articulated connection between the end of the longer arm 46*a* of lever 56 and pivot arm 30; i.e., the connecting rods 50 and 50' are pivotally connected to both lever 46 and pivot arm 30**.

Starting from the closed position of FIG. 1, if hydraulic jack 54 is actuated so as to cause its piston rod 52 to be extended, lever 46 will rotate about pivot 48 in the counterclockwise direction. The counterclockwise rotation of lever 46 about pivot 48 will be transmitted to pivot arm 30 by connecting rods 50 and valve member 22 will thus be caused to move to the open position as shown in FIG. 2. The movement of valve member 22 in the opening direction will terminate with the valve being completely removed from alignment with conduit 28 and thus valve member 22 will not be impinged upon by gas being discharged through the conduit. The valve is closed by operating hydraulic jack 54 in the opposite direction.

Since the pressure within conduit 28 may normally be quite high, a closing pressure must be applied to valve member 22 via hydraulic jack 54 during operation of the blast furnace; the closing forces applied thus exceeding those resulting from the counter-pressure prevailing in the furnace throat which may, for example, reach 3 bars. The evacuation of gases from conduit 28 is effected in the same manner as described in U.S. Pat. No. 3,601,357; i.e., when a shock wave or other over-pressure transient occurs the resulting forces generated on the inside of valve member 22 will exceed the closing force and valve member 22 will open slightly in opposition to the hydro-elastic forces produced by jack 54. The valve may also be automatically operated by sensing the pressure within conduit 28 and employing signals commensurate with the sensed pressure to control hydraulic jack 54 whereby abnormal pressures of long duration may be relieved.

Figures 4, 6:
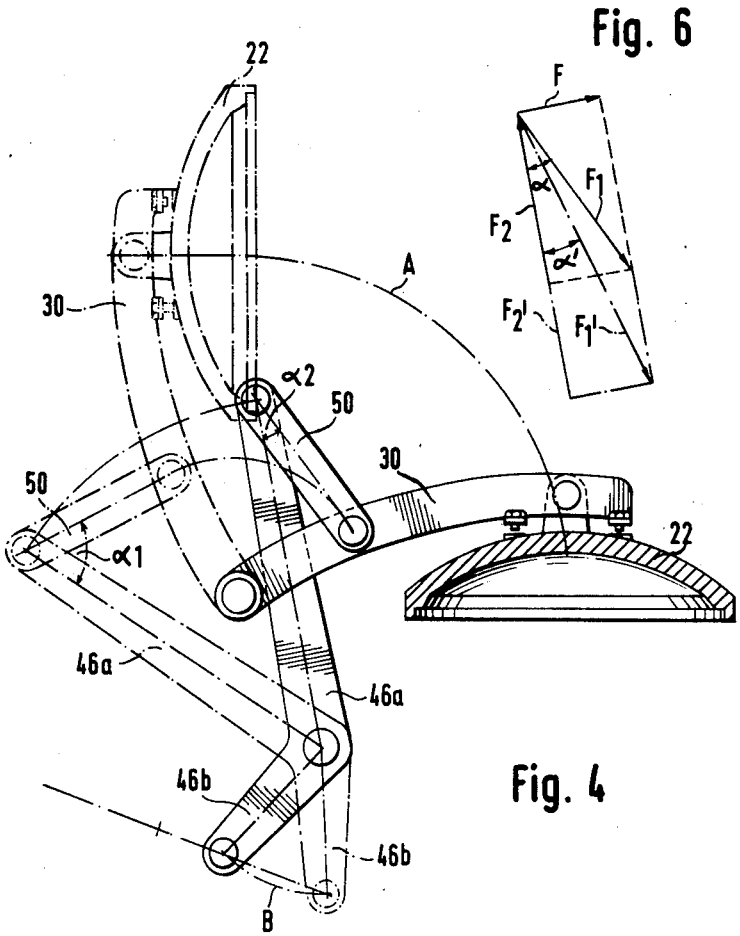
FIG. 4 is an isolated view showing the operation of the valve displacement mechanism in accordance with the embodiment of FIG. 1.
FIG. 6 is a vector analysis representing forces developed during operation of the embodiment of FIG. 1.

Referring jointly to FIGS. 1 and 6, when valve member 22 is maintained in the closed position by the thrust of jack 54, a force F is generated at the end of arm **46*a* of lever 46. The magnitude of force F depends on the length ratio between arms 46*a* and 46*b* of lever 46. A component F1 of force F is transmitted by connecting rods 50 and 50' to pivot arm 30 while a reaction force component F2 is generated in lever arm 46*a*. The closing force applied to valve member 22 will be equal to force component F1 multiplied by a ratio determined by the point of application of connecting rods 50 to pivot arm 30**.

The magnitude of the force component F1 transmitted by the connecting rods 50 and 50' is a function of the angle $\alpha$ between these connecting rods and lever arm **46*a*. As the angle $\alpha$ decreases, for example from $\alpha$ to $\alpha'$ as shown in FIG. 6, the force component F1 increases. Thus, the closing force applied to valve member 22 increases as angle $\alpha$ decreases and the smaller the angle $\alpha$ can be made the less the power that will be required from jack 54**.

Referring to FIG. 4, it may be seen that angle $\alpha 1$, representing the open position of valve member 22, is considerably greater than angle $\alpha 2$ representing the closed position of valve member 22. Consequently, for a given output power from jack 54, the force exerted on valve member 22 will be at its maximum with the valve in the closed position and at its minimum with the valve in the open position. Thus, in accordance with the present invention, the transmission ratio of the forces applied to the valve member is most favorable when the greatest amount of power is required and becomes less favorable under conditions when less power is required.

As an added advantage incident to use of the present invention, the linear speed of displacement of valve member 22 will also change as the angle $\alpha$ between connecting rods 50 and lever arm **46*a* changes. Whereas the transmission ratio of the forces is inversely proportional to the magnitude of angle $\alpha$, the linear speed at which valve member 22 moves when jack 54 is uniformly actuated is in direct proportion to the magnitude of angle $\alpha$. Thus, when valve member 22 is opened its speed of displacement increases progressively while the opposite result is obtained as the valve is closed. The valve member 22** is thus capable of moving over a relatively long trajectory A while the piston of the hydraulic jack need move over only a relatively short trajectory B. The requirement for a relatively short movement of the piston results in the further advantage that the consumption of hydraulic fluid is minimized.

Figure 5:
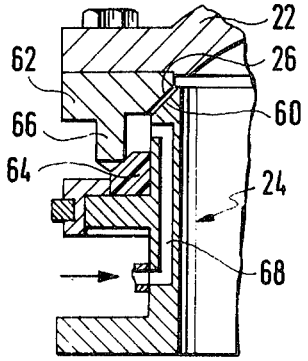
FIG. 5 is an enlarged, cross-sectional view depicting the cooperation between the valve member and valve seat of the embodiment of FIG. 1.

Referring to FIG. 5, the cooperation between the valve member 22 and valve seat 24 is shown by means of a partial view of the valve on an enlarged scale. Valve member 22 is preferably provided with a replaceable member or insert 62, comprised of a suitable metal, which defines the sealing surface 26. The sealing surface 26 may itself be formed from a commercially available material such as "ABRASODUR" and surface 26 is preferably of frustoconical shape. The cooperating surface 60 of valve seat 24 preferably has the shape of a spherical zone. The contact between the valve member and seat will thus be a closed circular line. It would, of course, be possible to omit replaceable member 62 and incorporate the sealing surface 26, comprised of a suitable material, on the periphery of an internal surface of valve member 22.

Regardless of whether the portion of valve member 22 which defines the sealing surface is removable, a compressible sealing ring 64 may also be provided to insure against leakage. If sealing ring 64 is present, the valve member will be provided with a projection 66, in the form of a circular rim, which contacts and thus compresses ring 64 when the valve is in the closed position. To enhance the life expectancy of the components of the valve, and particularly the sealing ring 64, a coolant may be injected into the annular region between the valve seat defining member 24, insert 62 and sealing ring 64. The coolant will be delivered via a passage 68 formed in seat defining member 24 and will both enhance the hermeticity of the valve and exert a cooling effect during the opening operation. Cooling will prevent deterioration of the elastic ring member 64 and will also prevent deformation of the metal components of the joint as a result of the temperature of the gases within conduit 28.

Figure 1A:
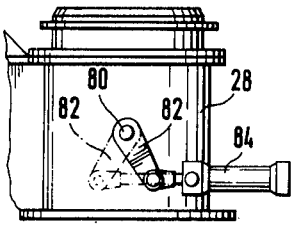
FIG. 1*a* is a partial side view of the apparatus of FIG. 1 depicting the actuator for the draft control valve member 78 of FIG. 1.

Referring again to FIG. 1, and also to FIG. 1*a*, a pivotal flap or valve member 78 may be installed within conduit 28 upstream of valve 20. The flap member 78 is mounted for rotation about a shaft 80 which is perpendicular to and intersects the axis of conduit 28. Shaft 80 will pass through the walls of conduit 28 and suitable sealing means will be employed to prevent leakage about shaft 80. The means for actuating the flap 78 is shown as comprising a hydraulic jack 84 having its piston rod connected, via a connecting rod 82, to shaft 80 for imparting rotation thereto. The hydraulic jack 84 and connecting rod 82 will, of course, be mounted to the exterior of conduit 28. The "closed" position of the valve flap 78 may be the position represented in broken lines in FIGS. 1 and 2; i.e., the closed position of the upstream valve may not correspond to a total blocking of conduit 28.

Figure 2:
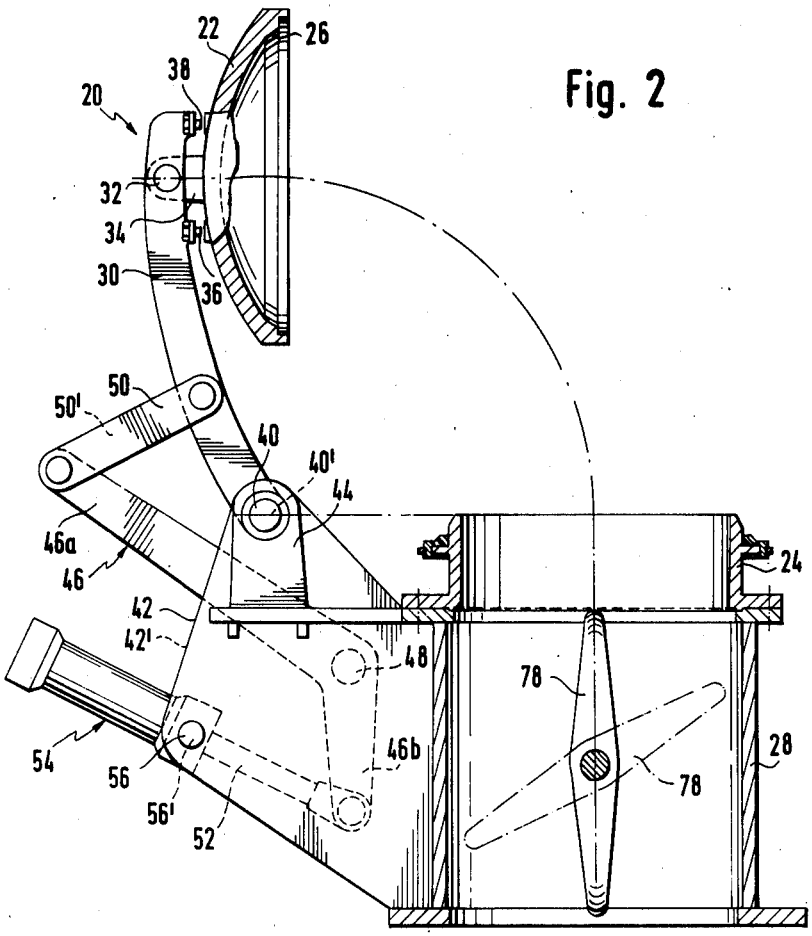
FIG. 2 shows the valve of FIG. 1 in the opened condition.

When the blast furnace is operating in the normal manner, the flap 78 will occupy the completely open position as shown in solid lines in FIGS. 1 and 2 regardless of whether the valve member 22 is in the closed or open position. The jack 84 should thus preferably be mounted such that its piston rod is retracted when the flap 78 is in the open position in order to prevent the piston rod from being normally exposed to the operating environment at the exterior of the furnace.

The purpose of the flap member 78 is to enable the draft of the furnace to be regulated when valve 20 is employed as a shut-down valve. As understood in the art, a "stoppage" of the furnace is not a total extinguishing thereof but rather this term relates to the operation of the furnace at a slow rate. During such a "stoppage" or slowing down, the charging process is interrupted and the furnace is generally isolated upstream from the hot air blast and downstream from the crude gas treatment unit. During this period the combustion in the furnace will be reduced to a minimum and ventilation will be effected by causing air to return through one or more tuyere stocks and exhaust gases will be released through a valve, such as valve 20, which for this particular purpose functions as a "shut-down" valve. While a blast furnace is generally equipped with three or four pressure relief or explosion prevention valves, normally a single "shut-down" valve is sufficient. Thus, in a typical installation there may be a plurality of valves such as valve 20 of FIG. 1 and one of these valves only will be equipped with a damper as defined by the flap 78.

Since flap 78 only serves to regulate the draft, it should not be actuated to the position shown in broken lines in FIG. 1 when valve member 22 is in the closed position. The operation of hydraulic jack 84 may thus be "slaved" to that of jack 54 in such a manner that the extension of the piston rod of jack 84 would be possible only when valve member 22 is actuated to the open position.

Figure 7:
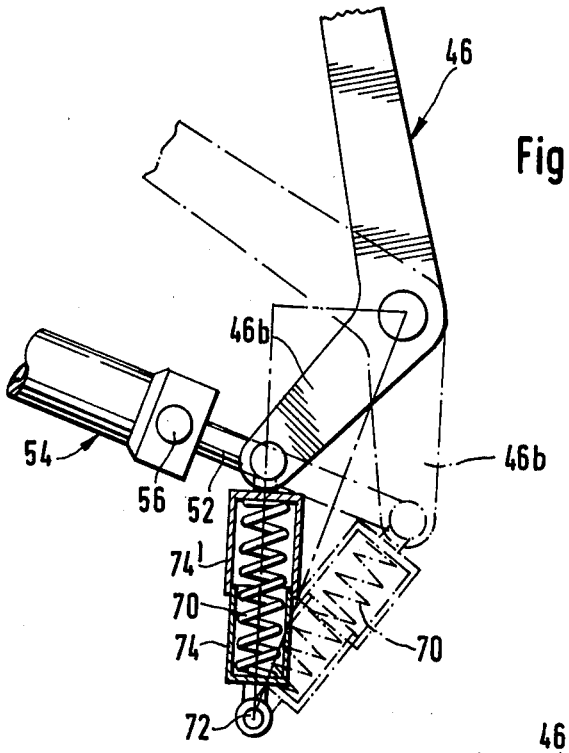
FIG. 7 is a partial schematic view of a first modification of the embodiment of FIG. 1.

FIG. 7 depicts a portion of the apparatus of FIG. 1 and shows a modification thereto. This modification comprises the addition of a spring 70 which acts on the lever 46. Spring 70 extends between a fixed support 72, which extends between plates 42 and 42′ of the valve support bracket, and the free end of the short lever arm 46*b*. Spring 70 is housed within a pair of telescoping cylindrical members 74 and 74′.

Continuing with a discussion of the modification of FIG. 7, during both the opening and closing of the valve the force of spring 70 must first be overcome and thereafter the spring aids in the desired movement. This results from the fact that, as the end of piston rod 52 moves from the position shown in solid lines to that shown in dotted lines in FIG. 7, respectively corresponding to the closed and open positions of valve member 22, spring 70 is first compressed and thereafter will expand. If spring 70 is prestressed to a pressure of about 0.3 to 0.4 bar it can keep the valve member 22 in the closed position if the furnace is operating without counter-pressure even if the hydraulic jack 54 is not functioning. Spring 70 thus constitutes a safety device since it can partially replace the hydraulic actuator when the latter is out of operation.

Figure 8:
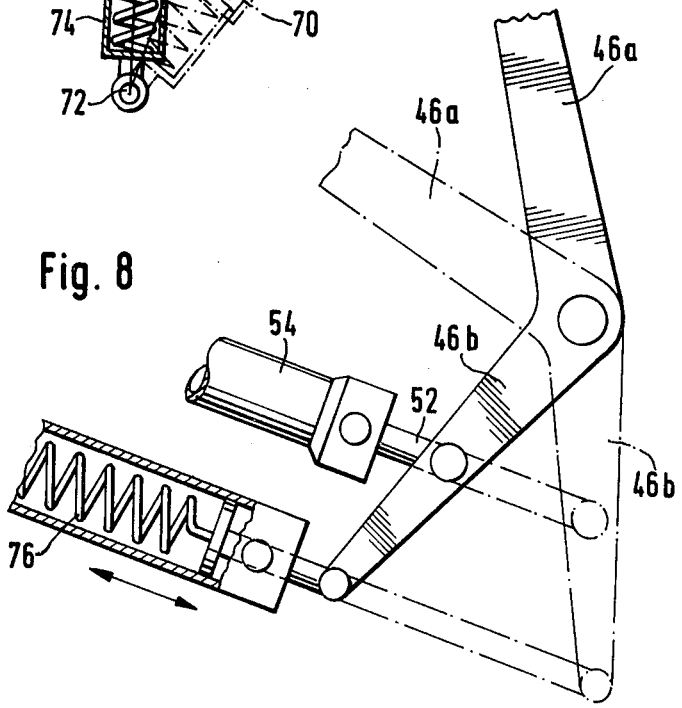
FIG. 8 is a partial schematic view of a second modification of the embodiment of FIG. 1.

Referring to FIG. 8, an alternative to the arrangement of FIG. 7 is shown. In FIG. 8 a spring 76, which will typically be a traction spring, acts on a prolongation of lever arm 46*b*. Thus, in FIG. 8 the opening of the valve is affected in opposition to the action of spring 76. It is, of course, possible to employ a compression spring and/or to reposition the spring to insure that it exerts the requisite pressure on the displacement mechanism so as to urge the valve member 22 in the closed direction with a pressure of at least 0.3 to 0.4 bar.

Referring generally to FIGS. 1–8, it is obviously possible to employ a pivot arm 30 which comprises only a single branch rather than the U-shaped member which has been shown. Use of a single pivot arm will permit use of a single connecting rod 50. However, if a single connecting rod 50 is employed, in order to impart the requisite strength to the assembly, the lever 46 will be in the form of a pair of spatially displaced parallel members.

Figure 9:
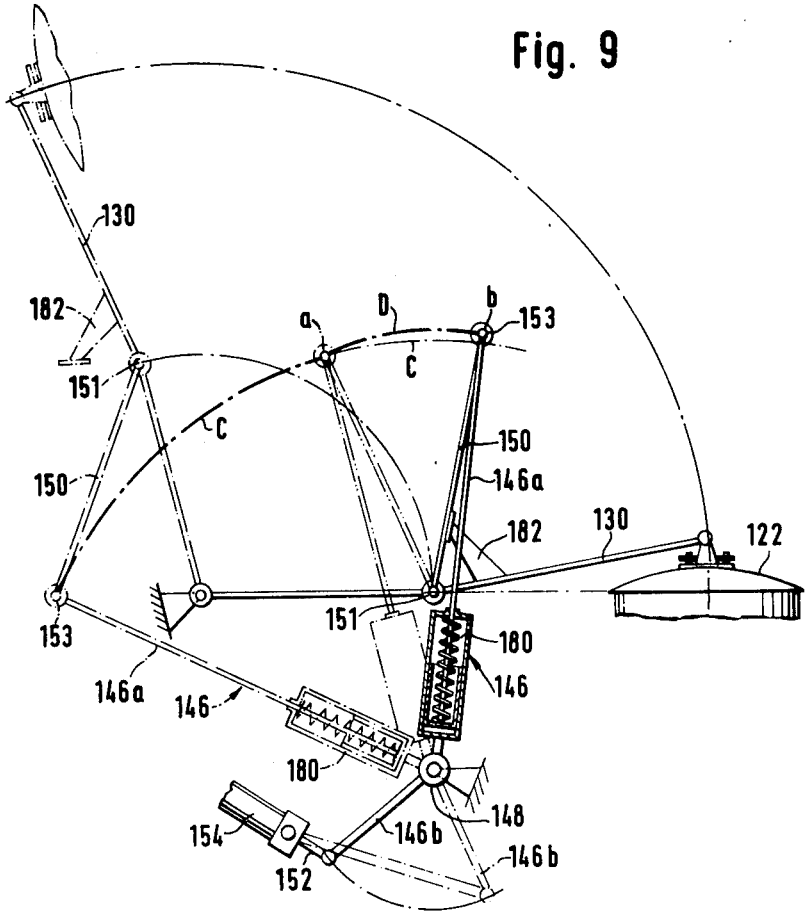
FIG. 9 is a schematic diagram of a second embodiment of the present invention, the embodiment of FIG. 9 being characterized by use of a telescoping valve displacement mechanism.

FIG. 9 represents, quite schematically, a second embodiment of the present invention. The apparatus depicted in FIG. 9 is used to operate the closure member 122 of a pressure relief valve between open and closed positions; the apparatus being represented in the position the various members will assume with the valve closed by means of solid lines and in the positions which will be assumed with the valve open by means of broken lines. The various elements have been shown diagrammatically in FIG. 9 since they will correspond to the elements of FIG. 1. Thus, referring to FIG. 9, the means for providing power to operate the valve comprises a hydraulic jack 154 having a piston rod 152 connected to the shorter arm 146*b* of a bent lever 146; lever 146 being rotatable about a pivot 148 and also including a longer arm 146*a*. The free end of lever arm 146*a* is articulated, by means of a pivot connection 153, to a connecting rod 150 which, in turn, is articulated to a pivot arm 130 by means of a pivot connection 151. The valve member 122 is connected to pivot arm 130 in the same manner as valve member 22 is connected to pivot arm 30 in the FIG. 1 embodiment.

The essential difference between the embodiment of FIG. 1 and that of FIG. 9 resides in the fact that the longer arm 146*a* of the lever 146 is telescopic in the FIG. 9 embodiment. In the interest of permitting the length of arm 146*a* to vary, a compression spring 180 is incorporated therein. Any elongation of lever arm 146*a* will be opposed by spring 180. As an additional distinction, pivot arm 130 may be provided with a stop 182 which contacts connecting rod 150 and thus terminates the movement of the connecting rod at a preselected position during closing of the valve.

Presuming that the valve member 122 is in the open position, and thus the components of the displacement mechanism are positioned as shown by broken lines in FIG. 9, when it is desired to close the valve the hydraulic jack 154 will be actuated so as to cause piston rod 152 to be retracted. The motion of the end of piston rod 152 is transmitted, via lever 146, connecting rod 150 and pivot arm 130 to valve member 122. During closing of the valve the interconnected ends of lever arm **146*a* and connecting rod 150, as indicated by pivot connection 153, move along an arcuate path as indicated at C until the valve member 122 reaches the closed position; the closed position of the valve corresponding to pivot connection 153 reaching point "a." Up to this point the operation of the FIG. 9 embodiment is identical to that of the FIG. 1** embodiment.

In the FIG. 9 embodiment the piston rod 152 continues to retract after valve member 122 is seated. With the valve closed, neither the valve member 122 nor pivot arm 130 is able to move further as the piston rod is retracted and, since the lever 146 will continue to rotate in the clockwise direction, the connecting rod 150 will rotate about the pivot 151 whereby it is articulated to pivot arm 130. Accordingly, continuing from point "a," the pivot connection 153 will continue to move in the clockwise direction but will follow an arcuate path D having a radius different from that of path C. The radius of curve C is, of course, defined by the initial length of lever arm **146*a* while the radius of curve D is defined by the length of connecting rod 150 which rotates about the now fixed pivot point 151. By comparing curves C and D in FIG. 9, it may be seen that the path followed by pivot connection 153 may result only from the extension of lever arm 146*a* against the bias of spring 180. Thus, the movement of pivot connection 153 from point "a" to point "b" is affected in opposition to the force of spring 180 until connecting rod 150 reaches a point where it is parallel to lever arm 146*a* after which the movement of the pivot connection is aided by spring 180. Movement of pivot point 153 is stopped by contact of connecting rod 150 with stop 182. Stop 182 will be positioned as shown such that pivot point 153 will not travel to the second intersection of curves C and D. Accordingly, spring 180 will remain in the compressed condition when the closing operation is terminated. The action of the hydraulic jack 154 is terminated as soon as connecting rod 150 contacts stop 182. It will be observed that the mechanical stop does not have to contact connecting rod 150 but could, for example, be incorporated in hydraulic jack 154**.

Spring 180 is selected so as to insure that it will exert sufficient force to keep valve member 122 closed in opposition to the counter-pressure prevailing in the furnace throat without the assistance of hydraulic jack 154. Since spring 180 functions to keep valve member 122 in the closed position in opposition to a pressure which may exceed 3 bars, the embodiment of FIG. 9 offers the advantage that hydraulic jack 154 may be disconnected when the valve is closed. Conversely, when the hydraulic actuator is inoperative for any reason, the blast furnace may continue to operate at the normal counter-pressure.

Figure 10:
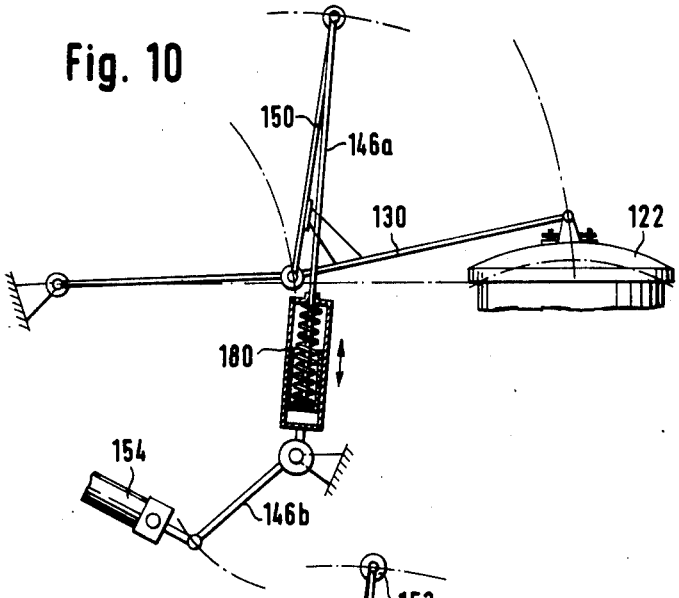
FIG. 10 is a further schematic diagram representing a particular mode of operation of the embodiment of FIG. 9.

Should, during operation of the furnace, there be a pressure surge such as incident to an explosion, the valve member 122 will be lifted in opposition to the action of spring 180 without causing any change in the angular position of lever 146. Such a condition is represented in FIG. 10. Accordingly, it is unnecessary for the embodiment of FIG. 9 to employ an actuator having hydro-elastic characteristics. In summary, in the embodiment of FIG. 9 the hydraulic jack 154 serves merely to move the valve member 122 during the opening or closing operation and, in so doing, to overcome the force of spring 180 in order to cause the pivot connection 153 to pass through the dead center position, i.e., the position where connecting rod 150 is parallel to lever arm **146*a***.

Continuing to refer to FIG. 10, the trajectory of valve member 122, when opened in response to impingement of a shock wave on the downwardly facing surface of the valve member, is extremely short. The valve may thus react instantaneously, and without recourse to a main control system, to an abnormal pressure. This mode of operation is, of course, a safety feature which permits excessive pressures to be vented in the case of a failure of the hydraulic actuator. In normal operation the hydraulic jack 154 will be actuated automatically when a predetermined pressure is exceeded. An initial opening under the influence of pressure, as represented in FIG. 12, will typically last only for a fraction of a second and in actual fact merely constitutes an initial opening operation the continuation of which will be affected under the action of a hydraulic control system.

Figure 11:
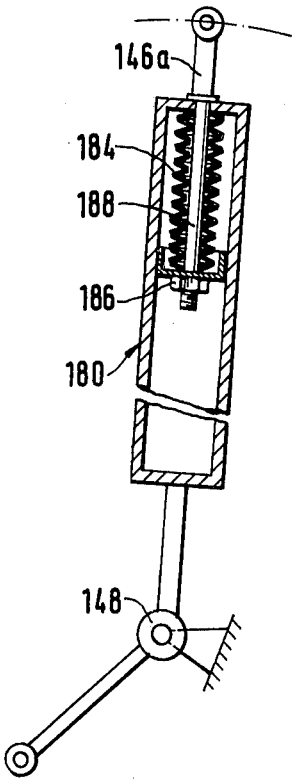
FIG. 11 is an enlarged view of the portion of the displacement mechanism of the embodiment of FIGS. 9 and 10.

FIG. 11 is a schematic illustration, on an enlarged scale, of one embodiment of spring 180 of the embodiment of FIG. 9. Spring 180 may advantageously consist of a plurality of elastic washers 184, of the type known in the art as "Belleville washers," which have been stacked on a rod 188 which forms a prolongation of lever arm **146*a*. The washers 184, which are dish-shaped, oppose compression and thus form a spring having a degree of prestressing which may be determined by means of an adjustment nut 186**.

Figure 13:
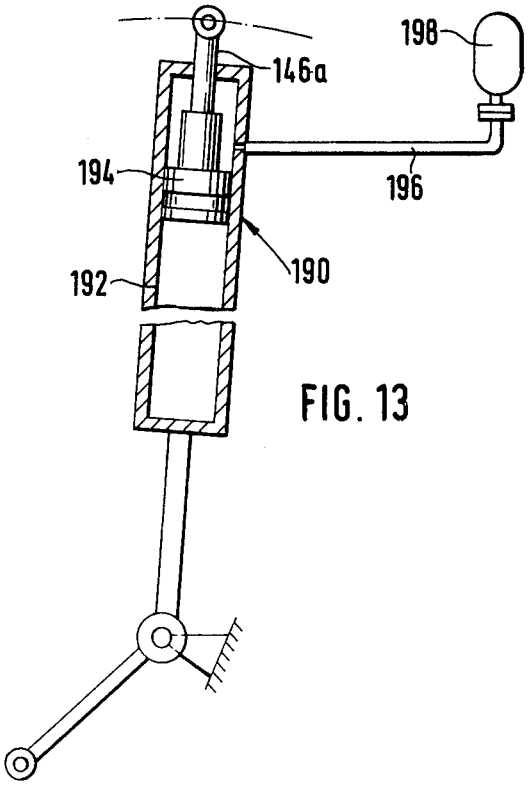
FIG. 13 is a schematic representation of a fourth embodiment of the present invention, the embodiment of FIG. 13 comprising a second varient of the embodiment of FIGS. 9 and 10.

Referring to FIG. 13, a hydraulic spring 190 may be used in place of the mechanical spring 180 as discussed above in connection with FIGS. 9–11. A typical hydraulic spring, as indicated schematically in FIG. 13, will include a cylinder 192 which is integral with lever arm **146*a*. A piston 194 travels in cylinder 192 and the piston rod is integral with a continuation of lever arm 146*a*. Movement of piston 194 in cylinder 192 causes hydraulic fluid to be ejected from the cylinder via conduit 196 and into an accumulator 198. When the pressure in the hydro-elastic accumulator 198 exceeds the tractional force exerted on piston 194, hydraulic fluid will be returned from accumulator 198 into cylinder 192**.

Figure 12:
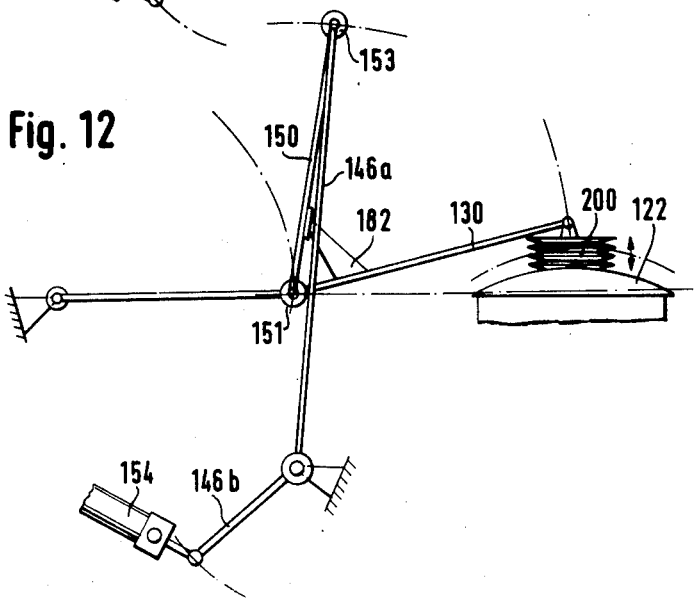
FIG. 12 is a schematic diagram a third embodiment of the present invention, the embodiment of FIG. 12 consisting of a varient of the embodiment of FIGS. 9 and 10.

FIG. 12 schematically and partially represents a further embodiment of the present invention which is an alternative to the arrangement of FIG. 9. In the FIG. 12 embodiment, rather than employing a telescoping lever arm **146*a*, a spring 200 is interposed between pivot arm 130 and the valve member 122. Spring 200, which will be in compression, may be comprised of "Belleville washers." The embodiment of FIG. 12 operates in substantially the same manner as the embodiment of FIG. 9. During a closing operation, after contact has been established between valve member 122 and the valve seat, the pivot point 151 will be displaced in opposition to the force provided by spring 200. Compression of spring 200 results in the pivot point 153 traveling between its limits of motion along the curve C of FIG. 9**;

i.e., the compression of spring 200 occurs as pivot point 153 moves between points a and b on curve C.

As in the case of the FIG. 9 embodiment, in the FIG. 12 embodiment it is not necessary to use an actuator with hydro-elastic characteristics and thus a simple hydraulic jack actuator suffices to cause opening and closing of the valve. Also, as in the case of the FIG. 9 embodiment, the hydraulic actuator can be rendered inoperative when valve member 122 is closed and the displacement mechanism occupies the position shown in FIG. 12. The closed position, like the corresponding position indicated in FIG. 9, is a "self-locking" position in that the displacement mechanism cannot be released except by actuating the jack 154 in such a way as to move the mechanism away from a mechanical stop and in opposition to the action of a spring.

Figure 14:
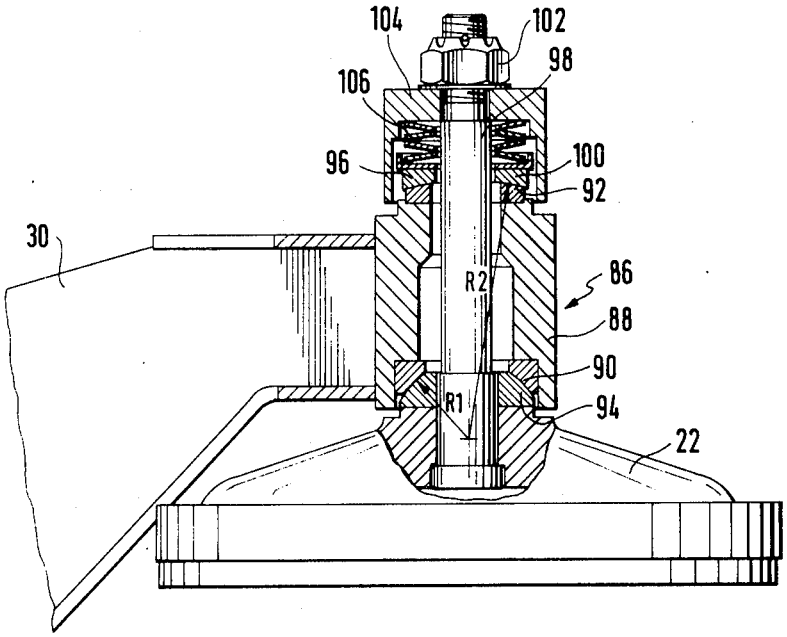
FIG. 14 is a cross-sectional view of a spring-biased ball joint which may be employed in various embodiments of the present invention.

FIG. 14 shows a ball joint assembly, indicated generally at 86, which may be employed to connect the valve member 22 to pivot arm 30. The ball joint comprises a tubular head 88 which is rigidly connected to the end of arm 30 by any suitable means. The head 88 is provided with an apertured insert which defines a spherically shaped convex upper bearing surface 92. Head 88 is also provided with a second apertured insert which defines a concave spherically shaped lower bearing surface 90. The two bearing surfaces 90 and 92 have the same center of curvature with their radii respectively being R1 and R2. Bearing surface 90 contacts a convex bearing member 94 which is coaxial with a rod 98; rod 98 and bearing member 94 both being supported on the upper surface of valve member 22. Upper bearing surface 92 cooperates with a concave surface 96 provided on a resiliently biased pressure disc 100; disc 100 being urged downwardly in the manner to be described below by means of a spring 106. All of the articulation surfaces 90, 92, 94 and 96 are of a generally annular shape so as to permit mounting of the bearing about the rod 98 which is affixed to and extends upwardly from the valve member 22. The upper end of rod 98 receives a lock nut 102. The locking nut contacts the upper outer surface of a cap 104 which serves as the housing for spring 106. The spring 106 may be comprised of a stack of "Belleville" washers.

In assembling the valve member 22 to pivot arm 30, the final securing action comprises the tightening of nut 102 in opposition to the action of spring 106. Nut 102 will be adjusted until the desired degree of friction is established between the cooperating bearing surface whereby there will be no relative movement between the valve member 22 and pivot arm 30 during the opening and closing of the valve; i.e., when the valve member is unseated. However, in order to insure that valve member 22 will seat correctly thereby establishing a leakproof seal, joint 86 must allow a slight pivoting movement of valve member 22 in relation to arm 30. This pivoting movement is permitted by spring 106 which may be further compressed when the valve member contacts the valve seat. The use of spherical joint 86 eliminates the necessity of employing adjusting screws such as screws 36 and 38 of the FIG. 1 embodiment.

Figure 15:
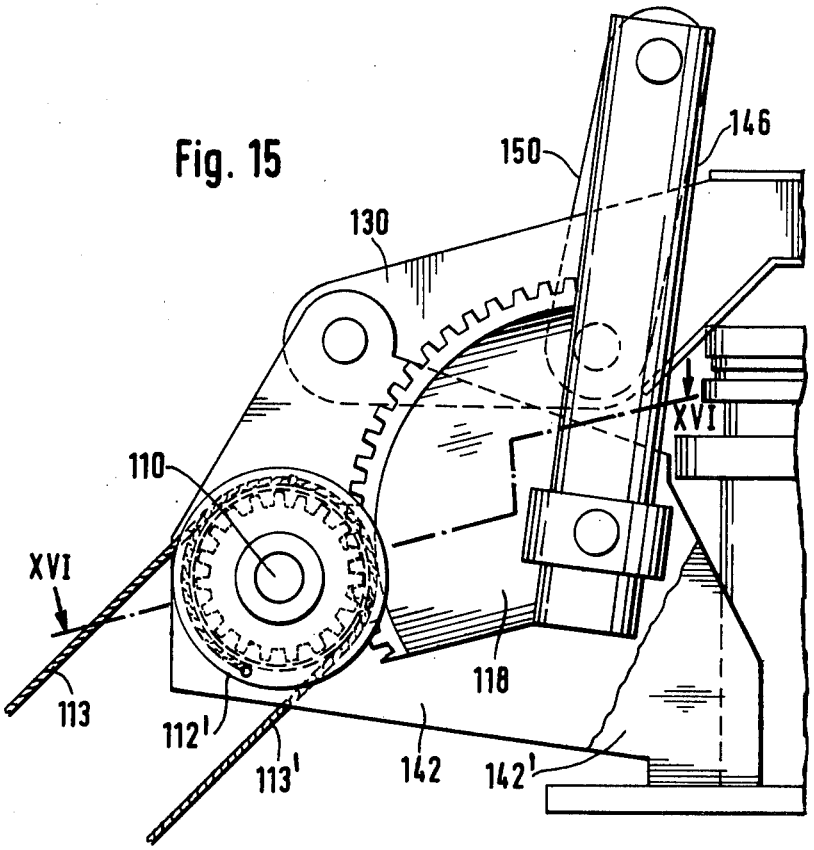
FIG. 15 is a partial schematic diagram of a fifth embodiment of the present invention wherein a mechanical actuator is employed for operating the valve.
Figure 16:
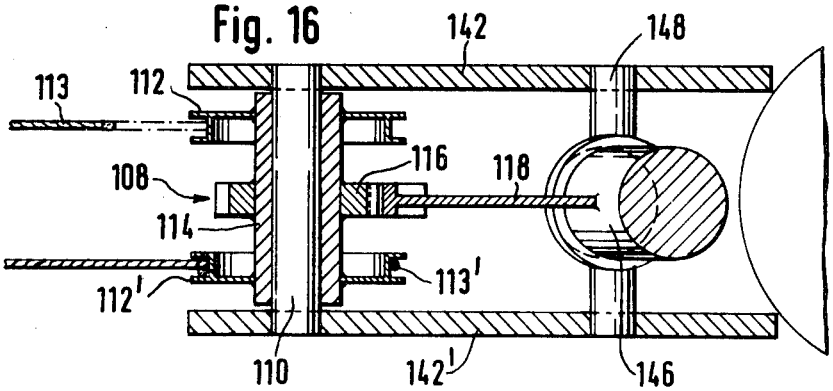
FIG. 16 is a cross-sectional view taken along line XVI—XVI of FIG. 15.

FIGS. 15 and 16 schematically and partially depict a valve actuating mechanism in accordance with the present invention wherein the hydraulic actuator has been replaced by a winch mechanism as indicated generally at 108. The displacement mechanism of the embodiment of FIGS. 15 and 16 may be similar to that represented by FIG. 9; i.e., the bent lever 146 will typically include a telescoping lever arm which acts on the pivot arm 130 through a connecting rod 150. As described above, the lever 146 will rotate with or about a pivot shaft 148 supported in plates 142 and 142' of the valve support bracket.

In the embodiment of FIGS. 15 and 16, a shaft 110 is provided between plates 142 and 142' for the purposes of supporting the winch 108. The winch includes a pair of pulleys 112 and 112' affixed to a common sleeve 114 which is capable of rotation about support shaft 110. The lever 146 is coupled to sleeve 114 by means of a gear drive comprising a toothed wheel 116 integral with the sleeve 114 and a sector 118 integral with lever 146. There may, of course, be any form of conventional gearing interposed between sleeve 114 and lever 146 and sector 118 may be a toothed sector having teeth which engage teeth in wheel 116. The gearing between wheel 116 and sector 118, however, may advantageously be provided by means of an articulated roller chain such as the type known in the art as a "Gall" chain. A chain of this kind offers the advantage, by comparison with conventional gearing, that the gearing is continually cleaned of debris which may accumulate thereon.

The pulleys 112 and 112' will, of course, be designed to be the right diameter to develop the force required for opening and closing the valve taking into account the ratio of the gearing between the sleeve 114 and lever 146.

As may be seen from FIG. 15, cables 113 and 113' are respectively wound about pulleys 112 and 112'; the two cables being wound in opposite directions and one being used for opening of the valve and the other for driving the valve in the closing direction. As shown in the drawing, cable 113 is employed for closing the valve while cable 113' is employed to move the displacement mechanism from the closed position, as represented in FIG. 15, to the open position. The cables may, of course, be replaced by chains or any other means suitable for exerting the requisite force on pulleys 112 and 112' and the cables can be operated either manually or by any suitable mechanism.

As will also be obvious to those skilled in the art, the embodiment of FIGS. 15 and 16 could be modified so as to permit use of an electric motor and suitable reduction gearing to actuate lever 146. The provision for possible manual operation, of course, permits the apparatus to be independent of a source of power and thus immune to operational difficulties in the case of either an electric power failure or loss of hydraulic pressure. Obviously, a combination of manually operated and driven control systems can be employed.

While preferred embodiments have been shown and described, various modifications and substitutions may be made thereto without departing from the spirit and scope of the invention. Accordingly, it will be understood that the present invention has been described by way of illustration and not limitation.

What is claimed is:

1. In a system for controlling the flow of gas between the interior of an enclosure and the ambient atmosphere via a conduit having an axis, the system including a valve comprising a movable valve member having a sealing surface which cooperates with a stationary valve seat, an improved actuating mechanism for the valve member comprising:

an elongated movable valve support member, said support member being connected to the valve member and being pivotal about an axis which is displaced from the point of connection of the support member to the valve member;

means for producing a valve actuation force;

lever means pivotable about an axis lying in a plane perpendicular to a plane in which the axis of the conduit lies, a first end of said lever means being coupled to said force producing means; and connecting rod means, said connecting rod means coupling the second end of said lever means to said support member intermediate the ends of said support member, said force producing means providing for the pivoting of said lever means to thereby transmit a valve actuation force via said connecting rod means to said support member to pivot said support member and the valve member between a position where the sealing surface of the valve member cooperates with the valve seat to prevent fluid flow through the conduit and a position where the valve member is completely removed from registration with the conduit.

2. The apparatus of claim 1 wherein said force producing means comprises:

a hydraulic actuator, said actuator having a piston rod output member which is coupled to said lever means first end.

3. The apparatus of claim 1 further comprising:

means permitting angular adjustment of the valve member with respect to said support member.

4. The apparatus of claim 3 wherein said angular adjustment permitting means comprises:

ball joint means connecting the first end of said support member to the valve member.

5. The apparatus of claim 4 wherein said ball joint means comprises:

means defining at least a pair of arcuate contact surfaces whereby the angular relationship between the valve member and support member may be varied;

means resiliently biasing said contact surfaces against one another; and means for adjusting the degree of resilient biasing whereby sufficient friction may be established between said contacting surfaces such that the valve member will not change its angular position with respect to said support member when the valve is in the open condition.

6. The apparatus of claim 1 wherein the axis about which said support member pivots is parallel to the axis about which said lever means pivots.

7. The apparatus of claim 6 wherein said connecting rod means is articulated to said support member and to the second end of said lever means.

8. The apparatus of claim 1 further comprising:

means resiliently biasing said lever means, said resilient biasing means assisting in maintaining the valve member in at least the closed position.

9. The apparatus of claim 1 wherein the valve member includes an insert, said insert being comprised of metal and defining the sealing surface which cooperates with the valve seat.

10. The apparatus of claim 1 wherein the valve seat includes a compressible sealing ring and wherein the valve member comprises a protrusion which contacts and compresses the sealing ring with the valve in the closed position.

11. The apparatus of claim 1 further comprising:

variable flow control means disposed in the conduit upstream of the valve member, said flow control means including a flap member pivotable about an axis which is perpendicular to the axis of the conduit.

12. The apparatus of claim 11 further comprising:

means mounted to the exterior of the conduit for actuating said flap member, said actuating means including a hydraulic actuator.

13. The apparatus of claim 1 wherein said force producing means comprises:

rotatable shaft means, said shaft means being oriented parallelly to the axis about which said lever means pivots;

means for selectively imparting clockwise and counterclockwise rotation to said rotatable shaft means; and gear means coupling said rotatable shaft means to said lever means.

14. The apparatus of claim 13 wherein said rotatable shaft means comprises at least a first pulley and wherein said means for imparting rotation to said shaft means comprises:

cable means engaging said first pulley.

15. The apparatus of claim 13 wherein said shaft means comprises:

a fixed shaft;

a sleeve rotatable about said shaft;

a pair of pulleys mounted on said sleeve; and a gear mounted on said sleeve for engagement by said gear means.

16. The apparatus of claim 15 wherein said means for imparting rotation to said shaft means comprises:

a first cable engaging said first pulley for imparting clockwise rotation thereto;

a second cable engaging said second pulley for imparting counterclockwise rotation thereto.

17. In a system for controlling the flow of gas between the interior of an enclosure and the ambient atmosphere via a conduit having an axis, the system including a valve comprising a movable member having a sealing surface which cooperates with a stationary valve seat, an improved actuating mechanism for the valve member comprising:

an elongated movable valve support member, said support member being connected to the valve member and being pivotal about an axis which is displaced from the point of connection of the support member to the valve member;

means for producing a valve actuation force;

lever means pivotable about an axis lying in a plane perpendicular to a plane in which the axis of the conduit lies, the axis about which said lever means pivots being parallel to the axis about which said support member pivots, the first end of said lever means being coupled to said force producing means; and connecting rod means, said connecting rod means coupling the second end of said lever means to said support member intermediate the ends of said support member, said connecting rod means being articulated to said support member and to the second end of said lever means, the angle between said connecting rod means and said lever means being less than 45° with the valve in the closed condition and being in excess of 45° with the valve in open condition.

18. In a system for controlling the flow of gas between the interior of an enclosure and the ambient atmosphere via a conduit having an axis, the system including a valve comprising a movable valve member having a sealing surface which cooperates with a stationary valve seat, an improved actuating mechanism for the valve member comprising:

an elongated movable valve support member, said support member being connected to the valve member and being pivotal about an axis which is displaced from the point of connection of the support member to the valve member;

means for producing a valve actuation force;

lever means, said lever means including a lever having first and second angularly related arms, said lever means being pivotable about an axis through the junction of said arms, the axis about which said lever means pivots being parallel to the axis about which said support member pivots, the free end of said first lever arm being coupled to said force producing means; and connecting rod means, said connecting rod means coupling the free end of said lever means second arm to said support member intermediate the ends of said support member, said connecting rod means being articulated to said support member and to said lever means second arm.

19. The apparatus of claim 18 further comprising:

spring means, said spring means extending between a fixed bracket and said first end of said lever means, said lever means first end being defined by the free end of said lever means first arm, said spring means biasing said lever means whereby the opening of the valve member will be effected in opposition to the spring bias while the closing of the valve member will be effected with the assistance of the spring bias.

20. The apparatus of claim 18 further comprising:

spring means connecting said support member to the valve member.

21. In a system for controlling the flow of gas between the interior of an enclosure and the ambient atmosphere via a conduit having an axis, the system including a valve comprising a movable valve member having a sealing surface which cooperates with a stationary valve seat, an improved actuating mechanism for the valve member comprising:

an elongated movable valve supporting member, said support member being connected to the valve and being pivotal about an axis which is displaced from the point of connection of the support member to the valve member;

means for producing a valve actuation force;

lever means pivotable about an axis lying in a plane perpendicular to a plane in which the axis of the conduit lies, said lever means including:

a first telescoping arm;

a second arm angularly related to said first arm, said lever means pivoting about the junction of said first and second arms;

means coupling the free end of said first arm to said force producing means; and means resiliently biasing said first arm in a first direction whereby said lever means first arm may be elongated in opposition to the resilient biasing during opening closing of the valve, said resilient biasing means thereby aiding and maintaining the valve in the closed position; and connecting rod means, said connecting rod means coupling the free end of said lever means second arm to said support member intermediate the ends of said support member.

22. In a system for controlling the flow of gas between the interior of an enclosure and the ambient atmosphere via a conduit having an axis, the system including a valve comprising a movable valve member having a sealing surface which cooperates with a stationary valve seat, an improved actuating mechanism for the valve member comprising:

an elongated movable valve support member, said support member being connected to the valve member and being pivotal about an axis which is displaced from the point of connection of the support member to the valve member;

means for producing a valve actuation force;

lever means pivotable about an axis lying in a plane perpendicular to a plane in which the axis of the conduit lies, said lever means including:

a first telescoping arm;

a second arm angularly related to said first arm, said lever means pivoting about the junction of said first and second arms, the axis about which said lever means pivots being parallel to the axis about which said support member pivots;

means coupling the free end of said first arm to said force producing means; and means resiliently biasing said first arm in a first direction whereby said lever means first arm may be elongated in opposition to the resilient biasing during closing of the valve, said resilient biasing means thereby aiding and maintaining the valve in the closed position; and connecting rod means, said connecting rod means being articulated to said support member and to the free end of said lever means second arm, said connecting rod means coupling said lever means to said support member intermediate the ends of said support member.

23. The apparatus of claim 22 further comprising:

stop means, said stop means limiting movement of the actuating mechanism in the closing direction whereby said resilient biasing means will remain in a stressed condition when the actuating mechanism reaches its said limit of movement.

24. The apparatus of claim 23 wherein said stop means is mounted on said support member and cooperates with said connecting rod means.

25. The apparatus of claim 23 wherein said resilient biasing means comprises:

a spring, said spring being aligned with said first arm to permit extension thereof, said spring being selected so as to exert a force on the valve member with the valve in the closed condition which exceeds the pressure normally contained by the valve.

26. The apparatus of claim 22 wherein said resilient biasing means exerts a closing force on said valve member in excess of the pressure which is to be normally contained by the valve.

27. The apparatus of claim 26 wherein said spring means comprises:

a stack of elastic washers.

28. The apparatus of claim 26 wherein said spring means comprises:

a hydraulic spring, said hydraulic spring including a hydraulic cylinder having a piston movable therein, said hydraulic cylinder being connected to an accumulator whereby said piston provides a hydro-elastic effect.

29. In a system for controlling the flow of gas between the interior of an enclosure and the ambient atmosphere via a conduit having an axis, an improved valve assembly comprising:

a stationary valve seat, said valve seat including a compressible sealing ring;

a movable valve member, said valve member including a protrusion which contacts and compresses the valve seat sealing ring with said valve in the closed position whereby gas flow through the conduit is prevented;

means for delivering a fluid coolant to the region defined by the sealing surfaces of said valve member and said valve seat and by the protrusion on the valve member and said sealing ring;

an elongated movable valve support member, said support member being connected to the valve member and being pivotal about an axis which is displaced from the point of connection of the support member to the valve member;

means for producing a valve actuation force;

lever means pivotable about an axis lying in a plane perpendicular to a plane in which the axis of the conduit lies, a first end of said lever means being coupled to said force producing means; and connecting rod means, said connecting rod means coupling the second end of said lever means to said support member intermediate the ends of said support member whereby said force producing means may cause the pivoting of said lever means to thereby transmit a valve actuation force via said connecting rod means to said support member to pivot said support member and the valve member between the valve open and closed position.

* * * * *